US005524968A

United States Patent [19]

Stoltz

[11] Patent Number: 5,524,968

[45] Date of Patent: Jun. 11, 1996

[54] GOLF CHAIR FOR THE HANDICAPPED

[76] Inventor: John Stoltz, 80 Rockwood Dr., Rockaway, N.J. 07866

[21] Appl. No.: 73,553

[22] Filed: Jun. 9, 1993

[51] Int. Cl.[6] ..... A47C 3/18

[52] U.S. Cl. ..... 297/344.21; 297/344.12; 297/468

[58] Field of Search ..... 297/344.21, 344.26, 297/344.12, 344.1, 468; 248/183, 125, 250

[56] References Cited

U.S. PATENT DOCUMENTS 1,786,663 12/1930 Leek ..... 297/468 X 2,550,415 4/1951 Kammermeyer ..... 248/183

3,312,477 4/1967 Dirksen .

4,266,748 5/1981 Dalton .

*Primary Examiner*—Richard E. Gluck

*Attorney, Agent, or Firm*—Anthony D. Cipollone

[57] ABSTRACT

The invention enables a disabled and handicapped person to play golf from a sitting position. The golf chair for the handicapped introduced permits a handicapped person to sit and play golf by proper adjustment and manipulation of the seat on the chair to change height angle of his or her position on the seat to swing a golf club.

2 Claims, 1 Drawing Sheet

GOLF CHAIR FOR THE HANDICAPPED

BACKGROUND OF THE INVENTION

1. Field of the Invention

There has been a crusade to insure and establish the rights of the handicapped culminating recently in the Americans with Disabilities Act.

The area of sports presents an interesting challenge in this area. Previously handicapped persons could not take part in even the most mundane activities. The present invention makes a giant stride in this field of endeavor. It will permit a handicapped person of the first time to actively take part in playing golf.

2. Prior Art

U.S. Pat. No. 3,312,477 introduces a movable support that may advantageously be used by a person laying carpet stripping adjacent to a wall surface.

U.S. Pat. No. 3,726,560 describes a dental stool with a base having casters permitting movement in a desired operating position.

U.S. Pat. No. 3,985,387 teaches a collapsible back pack chair adapted to be carried on the back of a user.

U.S. Pat. No. 4,131,260 shows a chair seat mount which permits the seat to tilt forward.

U.S. Pat. No. 4,232,896 relates to a portable and collapsible seat.

U.S. Pat. No. 4,266,748 has as its object a portable swivel hunter's stool.

U.S. Pat. No. 4,366,981 presents a standing work seat in which the support column and base are rigidly attached together, the support column is inherently rotatable, the seat is inclinable in the seat direction.

U.S. Pat. No. 4,451,080 is a mobility aid for use in conjunction with crutches or like, by a legless person or a person afflicted with paraplegia for step-like ambulating the aid having a foot with a convex lower surface.

OBJECT AND SUMMARY OF THE INVENTION

It is the object of this invention to permit a handicapped person to play golf. The invention centers about a pivotal chair which may be adjusted about the pivot for angular movement and adjusted up or down for varying heights and by the use of an adjustable tripod may be made amenable to varying surfaces.

The invention of this chair is a giant step in bringing handicapped persons to the field of sports, especially in this instance golf, which were previously outside the scope of activity for the handicapped.

The focal point of the instant invention is the use of the pivotal swivel joint on the chair as described in detail in the drawings with proper handle control and stops for angular movement in a circular direction and forward and backward movement to permit the handicapped person to play golf. He or she may bend forward to address the ball and then swing and move in a circular motion after hitting the golf ball to "follow through". In addition the tripod features permit the handicapped person to adjust to heights and different terrains on the golf course.

DETAILED DESCRIPTION OF THE DIAGRAM

Figure 3:
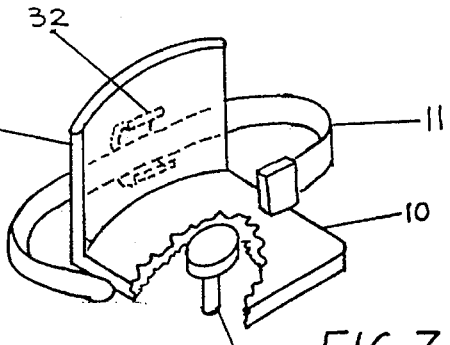
FIG. 3 is a detailed cutaway view of the chair portion of the invention.

FIG. 1.

A bracket (13) for seat rod (12) with clamp screw (14) is mounted to pivotal swivel joint (18) which has an adjustable screw handle (15) for horizontal movement with an adjustable handle (16) to control forward movement. An upper ball bearing ring (24) and lower ball bearing ring (25) contain two horizontal or swivel stops (braking system (19,20) with a swivel stop pin (21). The swivel joint (18) is connected to a vertical support rod (23) fitting through a bonnet (26) with a vertical adjustment screw knob (22) for raising or lowering the seat said bonnet (26) being a support and guide for the tripod unit comprising three legs (27) with lateral support legs (17,31) each with finger snap back (31) and each tripod leg (27) containing a finger snap back (28) for each tripod extension (29) the base of which has a leveling pad with screws (30).

Figure 2:
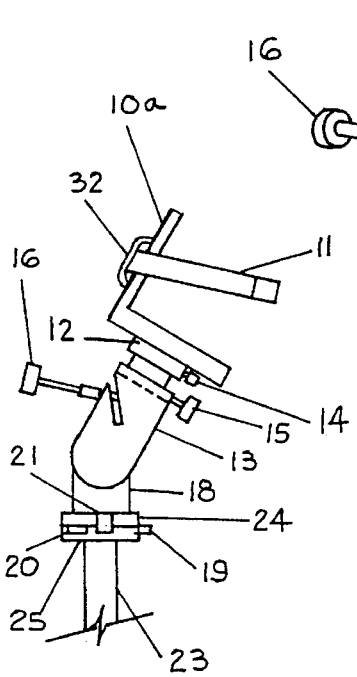
FIG. 2 is an imploded side view of the chair and pivotal swivel mechanism.
Figure 1:
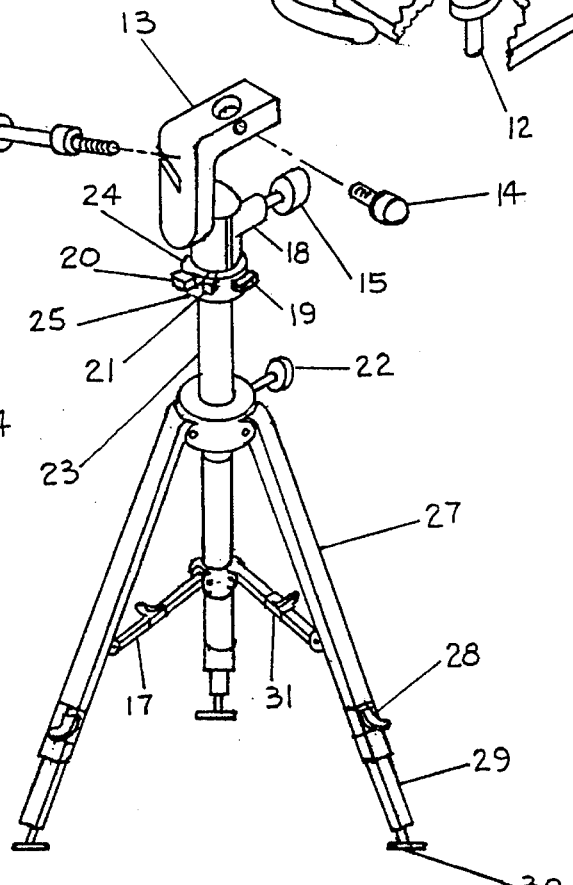
FIG. 1 is an orthogonal view of the golf chair for handicapped persons without the seat and is imploded to show all the parts.

FIG. 2 is a side expanded view of the chair and pivotal swivel mechanism.

A chair (10) with a restraining belt and buckle (11) held in place through a hook (32) on back of chair upright portion (3) is held onto a pivotal swivel joint (18) by rod (12) held in place by a clamp screw (14) which forms pivot unit of the rod (13) whose upper portion is equipped with a screw handle for horizontal movement and an adjustment handle (16) on its opposite side resting on vertical support rod (23) above which are upper (24) and lower (25) ball bearing rings having swivel brake stops (19) and stop pin (20) on lower ball bearing rings and horizontal or swivel stop (braking system) (21) or the upper ball bearing (24).

FIG. 3 is an imploded view of the chair portion of the invention supported and resting on bracket or seat rod (12) with chair back (10*a*) having a restraining belt and buckle (11) supported in place by belt loop (32) on chair back (10*a*).

What is claimed is:

1. A chair for use by a handicapped person for playing golf comprising:

a seat unit to which is attached a restraining belt and buckle;

said seat attached to a rod by means of a bracket and clamp screw;

said bracket attached to said rod, said bracket having attached to its outer face to the rear an adjustable handle for changing angle of said seat;

said seat bracket and rod forming an assembly attached to a swivel joint for ease of movement of said seat to various angles;

said swivel joint controlled by swivel stop pin located below said assembly on a donut-shaped upper ball bearing ring around said swivel joint just above a lower ball bearing ring;

said upper ball bearing ring and said lower ball bearing ring also containing a braking system or swivel stop;

said swivel joint supported by a vertical adjustable rod;

said vertical rod held within a bonnet which is a support and guide for tripod legs which are held and adjusted by two adjustable telescoping support legs each containing a finger snap lock acting perpendicularly to said tripod legs, said support legs restricting the outward movement of said tripod legs;

each tripod leg containing finger snap lock to adjust for leg extension;

each extension having at its end a leveling pad with screw.

2. The said chair in claim 1 adjusted to varying angles and heights to enable a handicapped person to handle a golf club and hit a golf ball.

* * * * *